US006532968B1

(12) United States Patent
Hafemann

(10) Patent No.: US 6,532,968 B1
(45) Date of Patent: Mar. 18, 2003

(54) BRUSH ATTACHMENT FOR HAND-HELD DEVICE DIFFUSING HOT AIR

(75) Inventor: Klaus Hafemann, Essen (DE)

(73) Assignee: Wik Far East Ltd., North Point (HK)

( * ) Notice: Subject to any disclaimer, the term of this patent is extended or adjusted under 35 U.S.C. 154(b) by 0 days.

(21) Appl. No.: 09/830,852

(22) PCT Filed: Aug. 17, 2000

(86) PCT No.: PCT/EP00/08012

§ 371 (c)(1),
(2), (4) Date: Jul. 30, 2001

(87) PCT Pub. No.: WO01/15568

PCT Pub. Date: Mar. 8, 2001

(30) Foreign Application Priority Data

Aug. 27, 1999 (DE) ..... 299 15 051 U

(51) Int. Cl.[7] ..... A45D 20/08; A45D 1/04; A45D 2/36; A45D 4/06

(52) U.S. Cl. ..... 132/271; 132/229; 219/222

(58) Field of Search ..... 132/271, 229, 132/123, 120, 233, 269; 219/222, 223, 224, 225, 226

(56) References Cited

U.S. PATENT DOCUMENTS 4,327,753 A * 5/1982 Bertschi ..... 132/270
4,411,281 A 10/1983 Doern ..... 132/37 R
5,091,630 A * 2/1992 Djuric ..... 219/222
5,133,372 A 7/1992 Seja et al. ..... 132/228
5,212,366 A * 5/1993 McDougall ..... 219/222
6,070,594 A * 6/2000 Mears ..... 132/123

FOREIGN PATENT DOCUMENTS

DE 8437528 3/1985
EP 0168099 6/1985

* cited by examiner

*Primary Examiner*—John J. Wilson
*Assistant Examiner*—Robyn Kieu Doan
(74) *Attorney, Agent, or Firm*—Flanagan & Flanagan; John R. Flanagan

(57) ABSTRACT

A brush attachment includes a coupling section attachable on a hand-held hot air device, a brush section having a bristle holder mounted axially through and rotatable relative to an outer housing part and bristle configurations movably mounted to the bristle holder and adapted to retract within and advance from the outer housing part when the bristle holder is rotated about an axis of rotation between first and second positions, an actuation device mounted to the coupling section and movable in a radial direction relative to the axis of rotation of the bristle holder, and a lever arm pivotally mounted to the coupling section and pivotally movable by the actuation device for actuating the bristle holder to cause rotation thereof between the first and second positions for retracting and advancing the bristle configurations into and from the outer housing part.

8 Claims, 4 Drawing Sheets

BRUSH ATTACHMENT FOR HAND-HELD DEVICE DIFFUSING HOT AIR

BACKGROUND OF THE INVENTION

The invention relates to a brush attachment for a hand-held hot air device for hair styling, for example a hair dryer, in particular such comprising a brush section with several bristle configurations disposed on a bristle holder axially rotatable relative to an outer housing part, comprising further a device for actuating the bristle holder to retract or advance the bristle configurations as well as a coupling section with means for attaching the brush attachment on a hand-held hot air device.

Such brush attachments are conventionally developed as round brushes with the bristles being disposed as a bristle configuration in individual bristle rows and supported in a bristle holder disposed so as to be rotatable relative to an outer tube serving as an outer housing part. An actuation device is kinematically connected with the bristle holder such that the actuation of the actuation element results in a rotational movement of the bristle holder, such that the bristles in their one position are retracted into the outer tube. Round brushes with retractable bristles or bristle configurations are employed in order to first form a curl and subsequently to be able to release the still warm curl to increase the resiliency.

In such a prior known round brush at the top of the brush attachment as the actuation device a pressure mechanism can be provided, which is disposed axially aligned with the longitudinal axis of the bristle holder. With the actuation element of this actuation device a translational movement relative to the rotational axis of the bristle holder is exerted for the purpose of retracting the bristles, which translational movement is converted via a threaded driver into a rotational movement of the bristle holder. Further round brushes with retractable bristles have become known, at the tip of which a rotation mechanism is disposed such that by rotation of the front tip of the brush attachment, the bristles can be retracted or exposed.

Such a brush attachment comprises at its end opposing the actuation device, a coupling section with suitable means for attaching the same on a hand-held hot air device, which connection means can be implemented, for example, in the manner of a bayonet connection. The interior of the brush attachment is formed such that the hot air stream blown out by the hand-held hot air device can be blown into the brush attachment and out through circumferentially disposed openings.

Of disadvantage in these prior known brush attachments is that a hand-held hot air device equipped with such a brush attachment as a so-called hair curler can only be operated using both hands. With the one hand, the hand-held hot air device must be held and operated; with the other hand the brush attachment must be actuated if the bristle configuration is to be retracted for releasing a curl.

SUMMARY OF THE INVENTION

Building on this discussed prior art, the invention is therefore based on the task of further developing a brush attachment according to the species discussed above, for a hand-held hot air device such that a hand-held hot air device equipped with such a brush attachment can be operated single-handedly.

This task is solved according to the invention thereby that the actuation device is disposed in the proximity of the coupling section of the brush attachment and that the actuation device has available an actuation element movable radially toward the rotational axis of the bristle holder which engages a coupling piece engaging the bristle holder for the purpose of transmitting the movement, directly radially toward the rotation axis of the bristle holder, of the actuation element onto the rotatable bristle holder.

The brush attachment according to the invention provides that the actuation device is provided in the proximity of the coupling section of the brush attachment and thus immediately in the proximity of the hand-held hot air device. The actuation device is therefore readily graspable and operatable with that hand with which the hand-held hot air device is being held. The actuation device itself is developed such that it comprises an actuation element movable radially toward the rotation axis of the bristle holder, which engages a coupling piece engaging the bristle holder for transmitting the movement, directed radially toward the rotation axis of the bristle holder, onto the rotatable bristle holder. Due to this implementation of the actuation element, actuation of the bristle holder for retracting and advancing the bristles can take place through a pressure movement, for example executed with the thumb against the housing, which is already being grasped in any event, of the hand-held hot air device. It is therein provided that the pressure actuation usefully takes place against the force of a spring element such that resetting the actuation device into the starting position, in which the bristles are exposed, occurs automatically.

A useful implementation of the invention provides that the coupling device of the actuation device is a lever disposed transversely to the direction of actuation of the actuation element as well as transversely to the rotation axis of the bristle holder. This lever is pivotably supported at the housing side and can be developed, for example, as a single-arm or also as a double-arm lever. Through this lever takes place a conversion of the actuation movement provided radially toward the rotation axis of the bristle holder into a rotational movement of the bristle holder. In order to implement the lever effect of the lever arm favorably, it is useful to dispose it eccentrically with respect to the rotation axis of the bristle holder since in this way the available cross section of the brush attachment in the proximity of its coupling can be utilized to the greatest extent.

The development is useful of a single-arm lever of the coupling piece, the one end of which is supported stationarily with respect to the rotational movement of the bristle holder, and whose free and movable other end engages the bristle holder, wherein the actuation element, with the actuation element engaging the lever between these two lever ends. The determination of the point of engagement of the actuation device on the lever depends on the desired magnitude of movement of the actuation device and the provided actuation pressure for exerting a bristle retraction.

The brush attachment according to the invention can be developed such that the actuation element must be actuated directly at the user side or that it is developed as a slider which is actuatable through a lever articulated on the housing of the brush attachment.

DESCRIPTION OF THE DRAWINGS

Further advantages and implementations of the invention are components of the dependent claims as well as of the following description of an embodiment example with reference to the enclosed Figures. In the drawing depict:

DETAILED DESCRIPTION OF THE INVENTION

Figure 1:
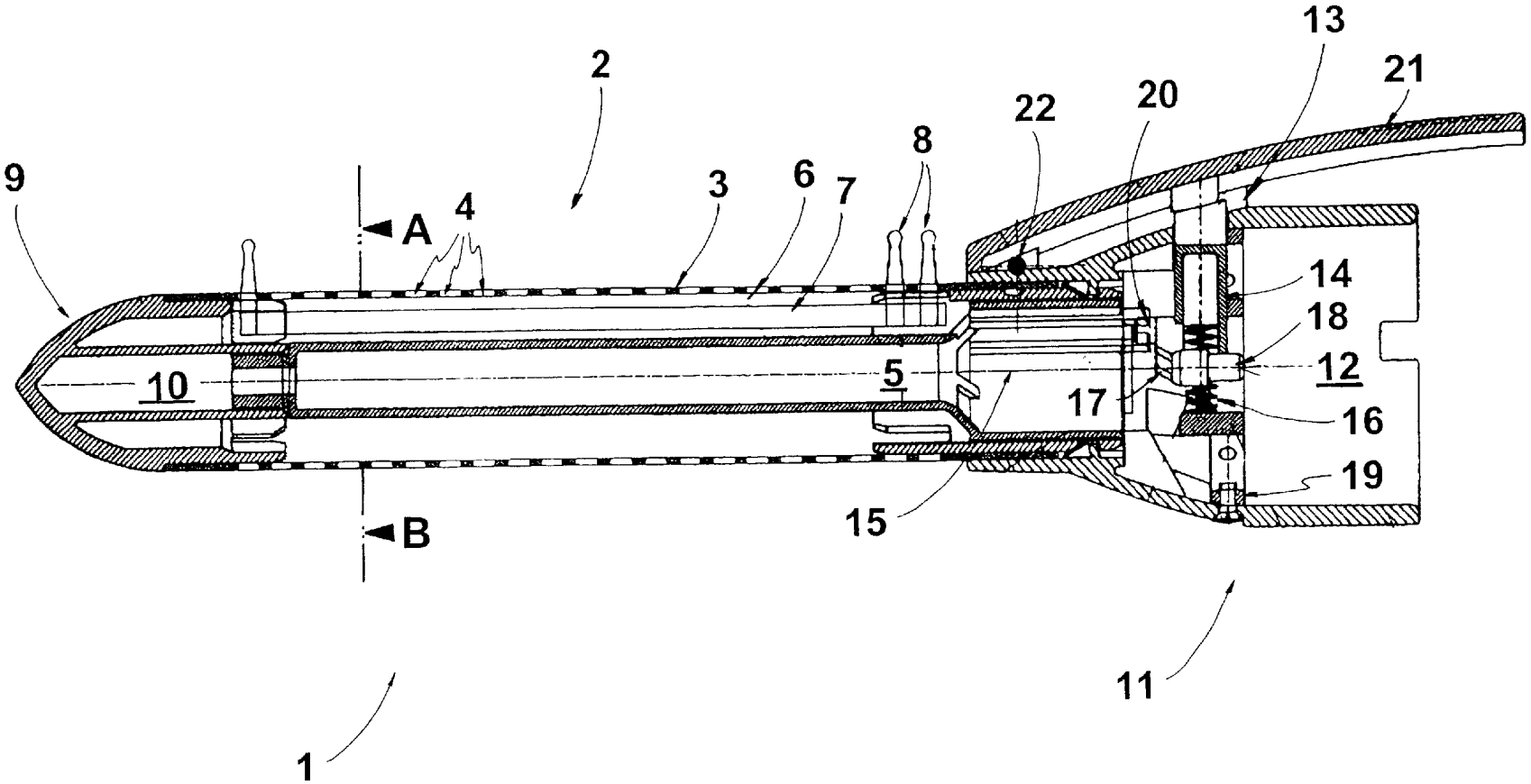
FIG. 1: cross section through a brush attachment for a hand-held hot air device for hair styling.

A brush attachment 1 for a hand-held hot air device, not further shown, for hair styling comprises a brush section 2, which is round in cross section. The brush section 2 is formed by an outer cylindrical tube 3 serving as an outer housing part, in which openings 4 are formed at intervals. Within the outer tube 3 is supported a bristle holder 5 disposed rotatably with respect to the outer tube 3. Radially encompassing the bristle holder 5 are provided bristle rows 6 as bristle configurations, which comprise a bristle bar 7 and bristles 8 disposed thereon. In FIG. 1, for the sake of clarity, only one row of bristles is shown with bristles 8 disposed only by example on the bristle rail 7. Each bristle row 6 is pivotably articulated with its bristle rail 7 on the bristle holder 5. The discrete bristles 8 of a bristle row 6 penetrate through the outer tube 3 through openings 4 in the outer tube 3.

The front tip of the outer tube 3 is closed by a plug 9 rounded off at the front. The plug 9 supports axially a sleeve 10 in which the bristle holder 5 is supported at the front side.

opposing the plug 9 the brush section 2 adjoins a coupling section 11 whose diameter is increased relative to that of the brush section 2. The coupling section 11 terminates at the end side in an adapter 12 developed as a coupler, with which the brush attachment 1 can be placed onto a hand-held hot air device, not depicted in the Figures.

In the proximity of the coupling section 11 is provided an actuation device 13 for actuating the bristle holder 5 in order to retract or expose the bristle row 6. The actuation device 13 comprises an actuation element 14 developed as a slider, which is supported axially movable toward the rotation axis 15 of the bristle holder 5 corresponding to the direction of arrow. The actuation element 14 is stayed at the underside on a compression spring 16 such that it is movable against the force of the compression spring 16 toward the rotation axis 15 of the bristle holder 5. Engaged with actuation element 14 is disposed a single-arm lever 17 transversely to the rotation axis 15 of the bristle holder 5 as well as transversely to the direction of actuation of actuation element 14 and serving as a coupling piece. The lever 17 supports at its end a pin 18 which is rotatably supported in an annular body 19 which, in turn, is screw-connected with the coupling section 11. The other end of lever 17 extends with a further pin 20 into a receptacle associated with the bristle holder 5. The actuation element 14 engages the lever 17 between the two pins 18, 20.

The actuation element 14 is actuatable through a control lever 21, which is pivotably articulated on the brush attachment 1 at the outside. The pivot axis of the control lever 21 is denoted by the reference number 22.

Figure 2:
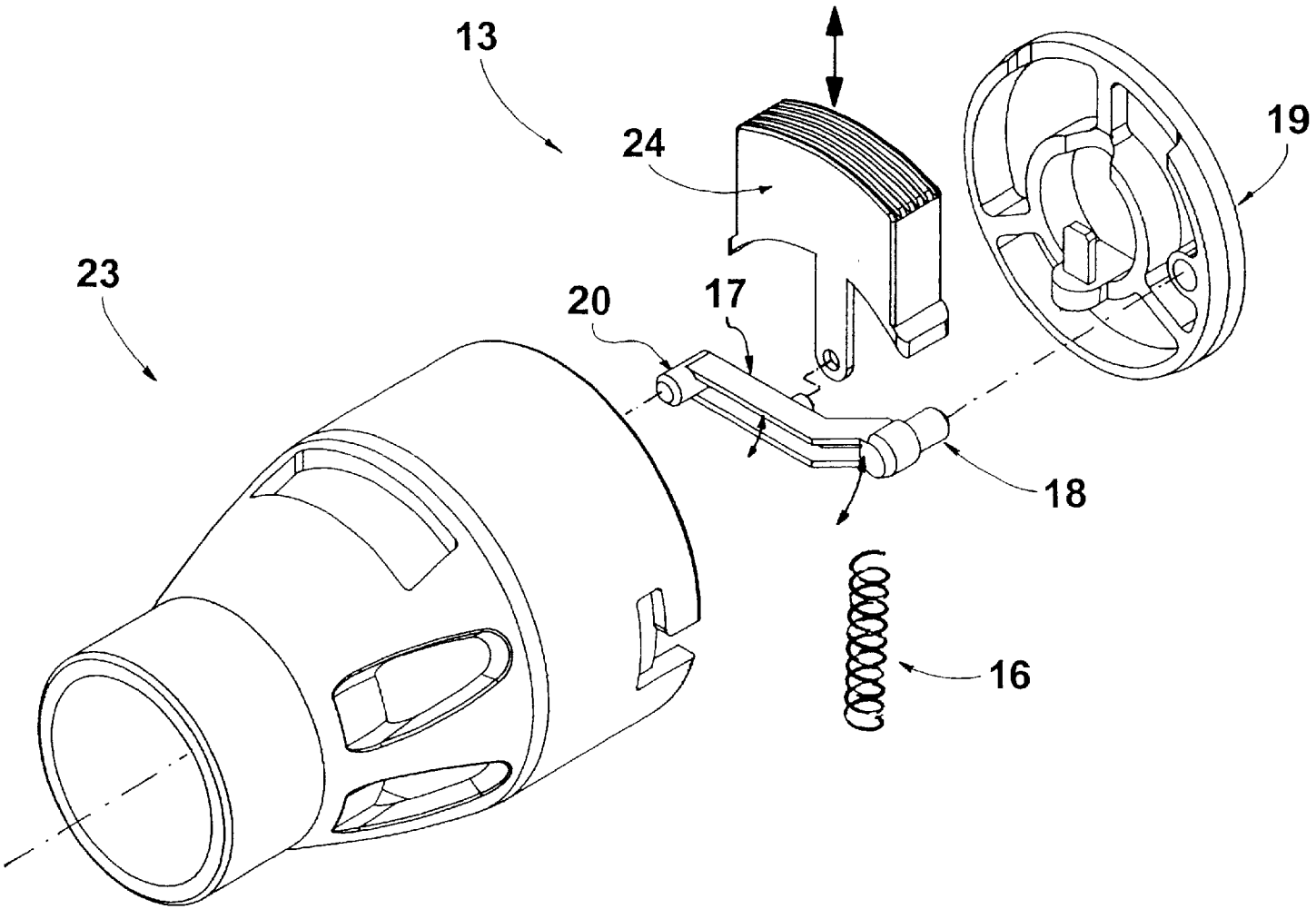
FIG. 2: three-dimensional view in the manner of an exploded representation of the essential elements of an actuation device of a further brush attachment.

In the exploded representation of FIG. 2 the coupling section is shown of a further brush attachment 23, not shown in further detail. The brush attachment 23 corresponds to the brush attachment 1 of FIG. 1; therefore identical elements are denoted by identical reference numbers. The sole difference between brush attachment 23 and brush attachment 1 resides therein that as the actuation element not a slider but rather a key button 24 is applied which is operated directly.

Figure 3:
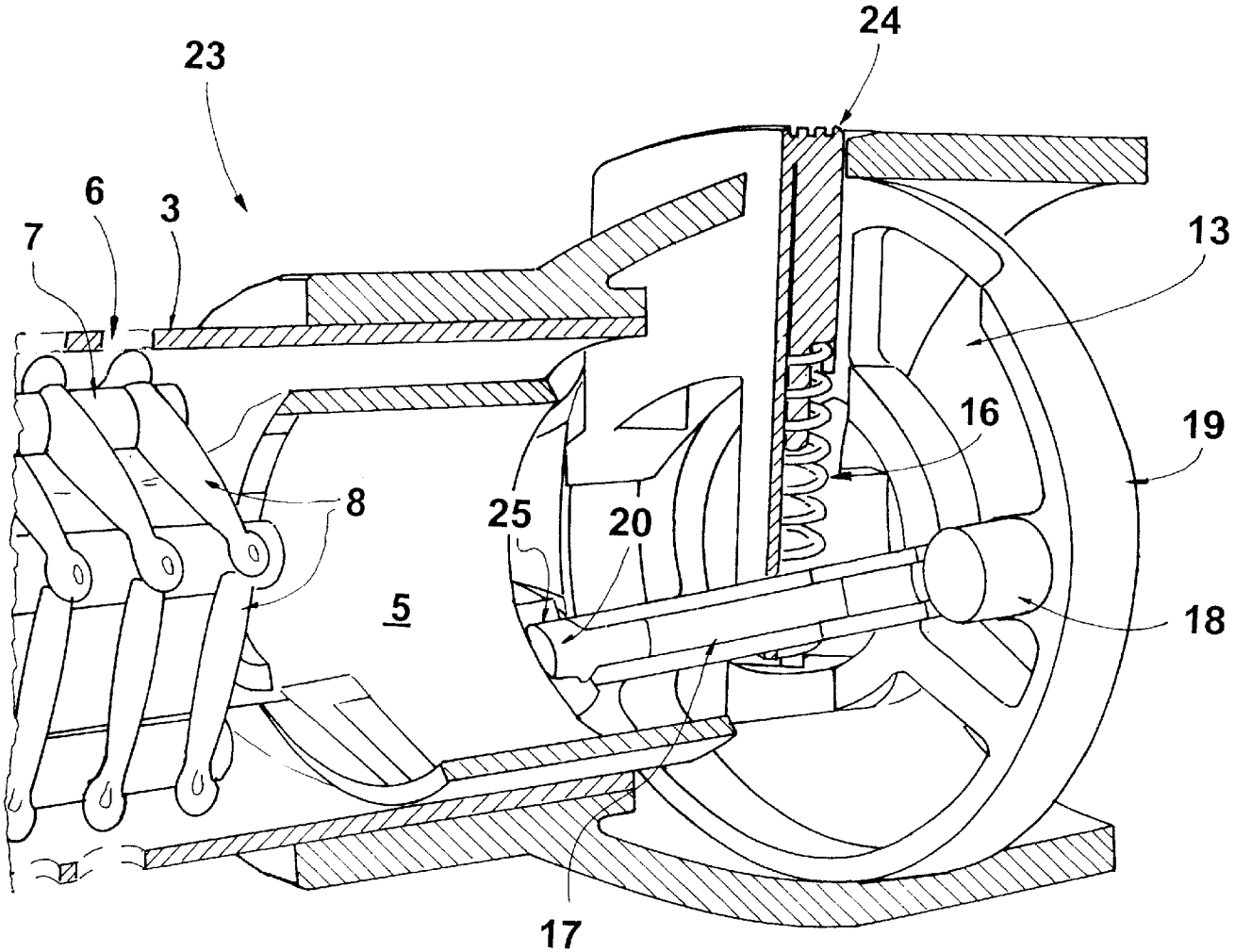
FIG. 3: three-dimensional view into the back region of the brush attachment of FIG. 2, FIG. 4: schematic cross section through the brush attachment of FIG. 1 along line A–B with the bristles retracted.

Especially clearly are evident in this Figure the elements used for the control device 13, namely the key button 24, the lever 17 and the annular body 19 which can be fastened on the housing side. Corresponding arrow representations reflect the possible movement and the corresponding movement course. Based on the view into the brush attachment 23 shown in FIG. 3, the cooperation of the discrete elements, key button 24, lever 17, annular body 19 and bristle holder 5 are evident. Lever 17 is, stationarily however rotatably, supported with its pin 18 in the annular body 19. The other end of lever 17 extends with its pin 20 into a receptacle 25 formed in the bristle holder 5. Since the key button 24 is also provided for actuating the lever 17, it is evident that with a radial movement of key button 24, these movements lead to a rotational movement of the bristle holder 5. FIG. 3 shows the brush attachment 23 with the actuated key button 24 and thus moved into the coupling section 11 of brush attachment 23. If the key button 24 is released, it is moved through the energy stored in the compression spring 16 out of the brush attachment 23, whereby lever 17 is pivoted about its pin 18 and through the rotational carrying-along of pin 20, the bristle holder 5 is rotated back by a certain angle. The bristle rows 6 pivotably disposed on bristle holder 5 are pushed through this movement out of the outer tube 3.

Figure 4:
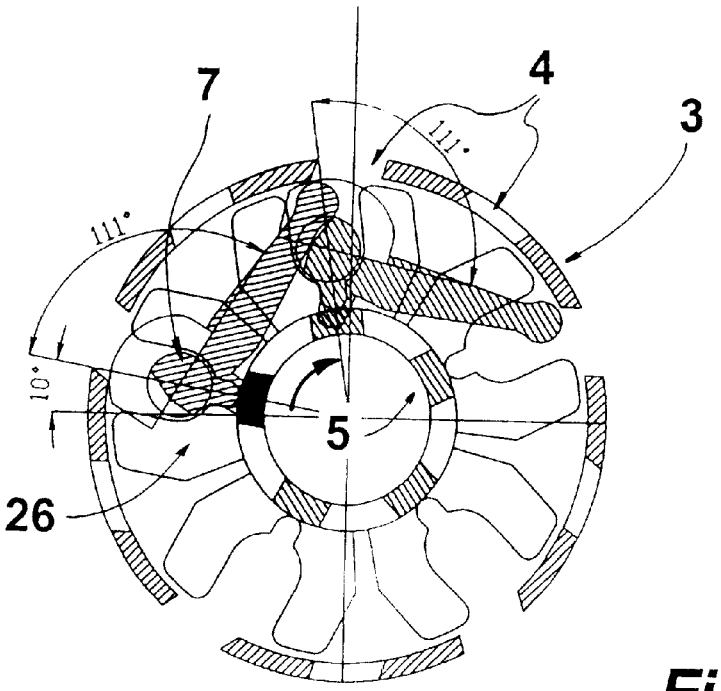
Figure 5:
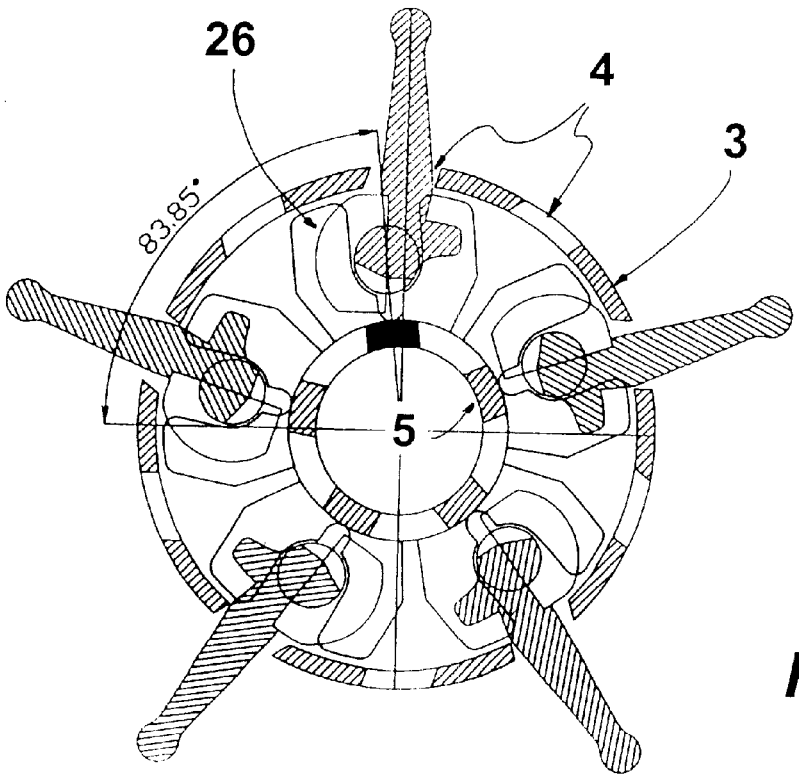
FIG. 5: schematic cross section through the brush attachment of FIG. 1 along line A–B with the bristles exposed.

The cross section shown in FIG. 4 through the brush section 2 shows by example the bristle holder 5 with two bristle rows 6 whose bristle bars 7 are articulated pivotably in corresponding receptacles 26 of the bristle holder 5. In FIG. 4 a section of bristle holder 5 is marked in black. When the control element 14 is released, the bristle holder 5 is moved according to the direction of arrow in FIG. 4, until the brush attachment 1 with the bristles 8 exposed attains its position shown in FIG. 5.

The actuation device shown in the Figures, as is in particular evident in FIG. 3, impairs only insignificantly a hot air stream flowing out of the hand-held hot air device. The disposition of the actuation device 13 within the air stream ensures the compact structure of the brush attachments shown in the Figures.

Compilation of Reference Symbols

1 Brush attachment
2 Brush section
3 Outer tube
4 Opening
5 Bristle holder
6 Bristle configuration
7 Bristle bar
8 Bristle
9 Plug
10 Sleeve
11 Coupling section
12 Adapter
13 Actuation device
14 Actuation element
15 Rotation axis
16 Compression spring
17 Lever
18 Pin
19 Annular body
20 Pin

21 Control lever
22 Pivot axis
23 Brush attachment
24 Key button
25 Receptacle with rotational carrying-along
26 Receptacle

What is claimed is:

1. Brush attachment for a hand-held hot air devil comprising:

(a) a coupling section attachable on a hand-held hot air device;

(b) a brush section including (i) an elongated outer housing part attached to and extending from said coupling section, (ii) a bristle holder mounted axially through said outer housing part so as to be rotatable relative thereto about an axis of rotation, and (iii) a plurality of bristle configurations movably mounted to said bristle holder and adapted to retract into said outer housing part when said bristle holder is rotated about said axis of rotation to a first position relative to said outer housing part and to advance from said outer housing part when said bristle holder is rotated about said axis of rotation to a second position;

(c) an actuation device mounted to said coupling section and being movable in a generally radial direction relative to said axis of rotation of said bristle holder; and (d) a device for actuating said bristle holder to cause rotation thereof between said first and second positions for retracting and advancing said bristle configurations into and from said outer housing part, said device for actuating said bristle holder including a lever arm having one end pivotally supported by said coupling section at a location stationary with respect to the rotational movement of said bristle holder and an opposite end pivotally coupled to said bristle holder at a location spaced radially outward from said axis of rotation thereof, said lever arm between said one and opposite ends thereof being engaged by said actuation device upon movement thereof along said radial direction such that said lever arm pivots and causes rotation of said bristle holder between said first position and said second position.

2. Brush attachment as claimed in claim 1, wherein said said device for actuating said bristle holder includes an annular body mounted to said coupling section and stationarily supporting said one end of said pivot arm.

3. Brush attachment as claimed in claim 1, wherein said elongated outer housing part has a plurality of openings defined therethrough through and from which said bristle configuration advance and retract when said bristle holder is rotated about said axis of rotation between said first and second positions.

4. Brush attachment as claimed in claim 1, wherein said lever arm extends transversely of said axis of rotation of said bristle holder.

5. Brush attachment as claimed in claim 1, wherein said lever arm extends transversely of said radial direction of movement of said actuation device.

6. Brush attachment as claimed in claim 1, wherein said actuation device is a slider mounted to undergo reciprocal movement along said radial direction.

7. Brush attachment as claimed in claim 1, wherein said actuation device also includes a spring element disposed adjacent to said actuation device such that when said actuation device is moved by a user in said radial direction toward said axis of rotation of said bristle member said actuation device moves against the force of said spring element whereupon release of said actuation device by the user said actuation device is moved by said spring element in said direction away from said axis of rotation of said bristle member.

8. Brush attachment as claimed in claim 7, wherein said actuation device is a slider mounted to undergo reciprocal movement along said radial direction.

* * * * *